US007493855B2

(12) United States Patent
Boppel et al.

(10) Patent No.: US 7,493,855 B2
(45) Date of Patent: Feb. 24, 2009

(54) METHOD FOR THE PRODUCTION OF A PRINTED PRODUCT, PROCESSING DEVICE, AND SYSTEM FOR THE PRODUCTION OF PRINTED PRODUCTS

(75) Inventors: Johannes Boppel, Frankenthal (DE); Peter Wilhelm Kurt Leidig, Frankenthal (DE)

(73) Assignee: Koenig & Bauer Aktiengesellschaft, Würzburg (DE)

( * ) Notice: Subject to any disclaimer, the term of this patent is extended or adjusted under 35 U.S.C. 154(b) by 379 days.

(21) Appl. No.: 10/553,202

(22) PCT Filed: Apr. 14, 2004

(86) PCT No.: PCT/EP2004/050522

§ 371 (c)(1),
(2), (4) Date: Oct. 13, 2005

(87) PCT Pub. No.: WO2004/089631

PCT Pub. Date: Oct. 21, 2004

(65) Prior Publication Data

US 2006/0196380 A1 Sep. 7, 2006

(30) Foreign Application Priority Data

Apr. 14, 2003 (DE) ..... 103 17 262

(51) Int. Cl.
*B41F 13/56* (2006.01)

(52) U.S. Cl. ..... 101/224; 101/225; 101/226

(58) Field of Classification Search ..... 101/216, 101/224, 225, 226, 227, 228
See application file for complete search history.

(56) References Cited

U.S. PATENT DOCUMENTS

| | | | | |
|---|---|---|---|---|
| 3,948,504 | A * | 4/1976 | Woessner et al. | 493/324 |
| 5,606,914 | A | 3/1997 | Borgardt | |
| 5,735,203 | A * | 4/1998 | Taniguchi et al. | 101/126 |
| 6,058,844 | A | 5/2000 | Niemiec | |
| 6,109,182 | A * | 8/2000 | Vestman et al. | 101/483 |
| 6,220,157 | B1 * | 4/2001 | Delwiche et al. | 101/178 |
| 6,298,781 | B1 * | 10/2001 | Dufour | 101/483 |
| 6,338,707 | B1 * | 1/2002 | Michalik | 493/357 |

(Continued)

FOREIGN PATENT DOCUMENTS

DE 43 25 725 A1 2/1995

(Continued)

*Primary Examiner*—Daniel J Colilla
*Assistant Examiner*—David Banh
(74) *Attorney, Agent, or Firm*—Jones, Tullar & Cooper, PC

(57) ABSTRACT

A printing system is used for printing newspapers or for job printing and includes a web-fed press, including an unreeling stand, and one or more printing units for printing a web that is unrolled from a roll at the unreeling stand. A re-rolling stand may be used to wind up the web, after it has passed through the printing units. A separating device forms a second part of the printing system and includes an unreeling stand which can receive a roll of a printed web. The printed web can be unrolled and can be directed to a subassembly from this re-rolling stand. In the subassembly, the further processing of the web can take place at a different time and place, and at a different speed than the original printing of the web.

5 Claims, 2 Drawing Sheets

U.S. PATENT DOCUMENTS

| | | | | |
|---|---|---|---|---|
| 6,360,665 | B1 * | 3/2002 | Hartmann et al. | 101/483 |
| 6,375,605 | B1 * | 4/2002 | Niedermeyer | 493/359 |
| 6,551,685 | B1 * | 4/2003 | Wojewoda et al. | 428/132 |
| 6,705,982 | B1 * | 3/2004 | Cote et al. | 493/447 |
| 6,821,038 | B2 * | 11/2004 | Izawa | 400/621.1 |
| 6,827,012 | B1 * | 12/2004 | Palmatier | 101/225 |
| 6,886,823 | B2 * | 5/2005 | Herbert | 270/20.1 |
| 7,243,602 | B2 * | 7/2007 | Saupe | 101/480 |
| 7,243,827 | B2 * | 7/2007 | Lehrieder | 226/92 |
| 2002/0046666 | A1 * | 4/2002 | Bialek | 101/226 |
| 2002/0078839 | A1 * | 6/2002 | Walczak et al. | 101/217 |
| 2002/0181002 | A1 * | 12/2002 | Leyva | 358/1.13 |
| 2004/0108403 | A1 * | 6/2004 | Ueyama et al. | 242/530.3 |

FOREIGN PATENT DOCUMENTS

| | | | |
|---|---|---|---|
| DE | 43 25 725 | C2 | 2/1995 |
| DE | 198 37 117 | A1 | 2/2000 |

* cited by examiner

METHOD FOR THE PRODUCTION OF A PRINTED PRODUCT, PROCESSING DEVICE, AND SYSTEM FOR THE PRODUCTION OF PRINTED PRODUCTS

CROSS-REFERENCE TO RELATED APPLICATIONS

This patent application is the U.S. national phase, under 35 USC 371, of PCT/EP2004/050522, filed Apr. 14, 2004; published as WO 2004/089631 A2 on Oct. 21, 2004, and claiming priority to DE 103 17 262.9, filed Apr. 14, 2003, the disclosures of which are expressly incorporated herein by reference.

FIELD OF THE INVENTION

The present invention is directed to a method for producing a printed product, to a device for further processing a printed product, as well as to an installation for producing printed products. A web of material is taken from a roll, is printed and is then re-rolled. Several re-rolled printed web are then processed further.

BACKGROUND OF THE INVENTION

DE 43 25 725 C2 shows a web-fed rotary printing press with a hot air dryer and cooling rollers. A web is rolled up again after having been printed.

DE 198 37 117 A1 describes a method for producing newspapers. Webs which have been imprinted with the editorial contents and with the contents of inserts are wound on assigned rolls. The rolls, which are required for a complete newspaper, are then rolled off again, are combined with other webs and are longitudinally folded.

U.S. Pat. No. 3,948,504 discloses an installation for processing two imprinted webs of material, each of which is rolled off a roll changer. Each one of these webs of material is longitudinally cut and is then conducted over turning bars to the longitudinal former. All longitudinally folded partial webs are transversely cut downstream of the longitudinal former.

SUMMARY OF THE INVENTION

The object of the present invention is directed to providing a method for producing a printed product, to providing a device for further processing, as well as to providing an installation for producing printed products.

In accordance with the present invention, this object is attained by printing a material web which has been unwound from a roll and which is then re-wound as a new roll after printing. Several previously printed webs can be then unwound and can be further processed. The initial web printing installation and the further processing location can both be in a single building. The previously printed webs can be separated into partial webs.

The advantages to be attained by the present invention consist, in particular, in that a very high degree of production flexibility is achieved by the use of the method of the present invention. The present method permits 100% utilization of the press production speed which can be reached by the web-fed printing press, regardless of the working speed of the separating devices. Also, by the use of the method of the present invention, it is very simple to produce printed products which are put together from different parts, one of which can, for example, be produced in high numbers and which can be arbitrarily combined with at least a second part, of which different versions are produced, each at lower numbers.

A printing installation for printing newspaper or for job printing is divided, on the one hand, into a web-fed printing press with an unreeling device and with one or with several print units for imprinting a web rolled off a roll by operation of the unreeling device, and with a re-reeling device for use in rolling up the web after its passage through the print units. On the other hand, the printing installation also includes a separating device, in which an unreeling device is connected directly with the inlet of a structural component. A web, which was imprinted in the rotary printing press, is supplied to the separating device in the form of a roll. Imprinting of the web and separation of the web become independent of each other in this way; they can take place at different times, in different locations and/or at different speeds.

BRIEF DESCRIPTION OF THE DRAWINGS

Preferred embodiments of the present invention are represented in the drawings and will be explained in greater detail in what follows.

Shown are in.

DESCRIPTION OF THE PREFERRED EMBODIMENT

Figure 1:
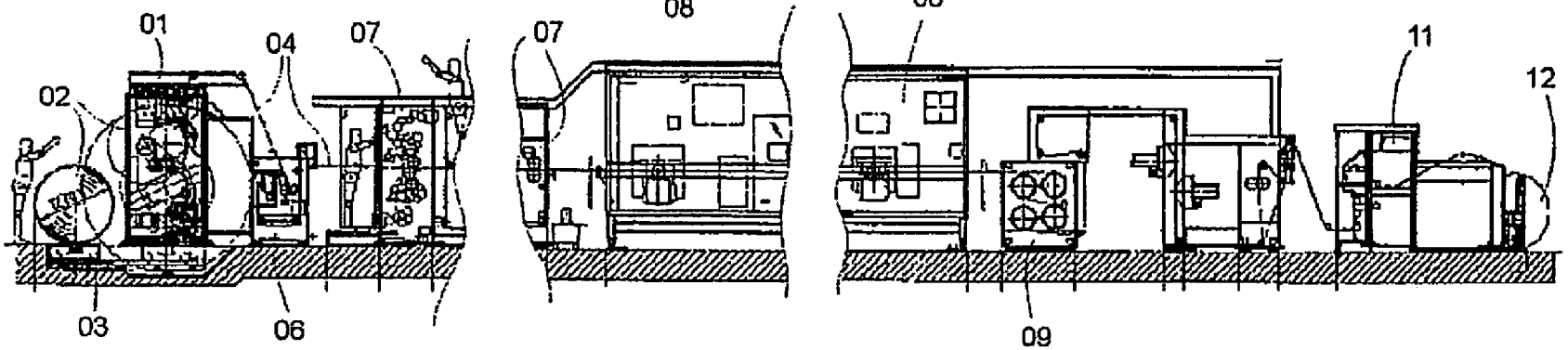
FIG. 1, a schematic side elevation view of a web-fed printing press in accordance with the present invention, in FIG. 2, a side elevation view of a separating device in accordance with the present invention, and in FIG. 3, a top plan view of the separating device in accordance with the present invention.

Referring initially to FIG. 1, there may be seen a schematic depiction of a printing press in accordance with the present invention. The first structural component of the printing press shown in FIG. 1 is an unreeling device 01, which here is depicted as a roll changer 01, to which rolls 02 of material to be imprinted, and in particular paper rolls 02, are conveyed by the use of transport carts 03, which run on rails placed under the floor of a building into which the printing press has been placed. A web 04 of material is discharged from the unreeling device 01, which web of material 04 is, in particular, a paper web 04. Web 04 initially passes through a draw-in unit 06, whose job it is to feed the web 04 to subsequent structural processing groups at a well defined tension, which tension is kept identical across the width of the web 04 and which remains chronologically unchanged.

These subsequent structural processing groups are first a plurality of print units 07, each of which print units 07 imprints the front and back of the web 04 in a color. The schematic representation depicted in FIG. 1 shows offset print units. However, other printing techniques can also be considered. The printing press is embodied as a newspaper printing press, such as, for example, one in which several printing plates are arranged side-by-side in the axial direction of the forme cylinder, or as a printing press for jobbing, in which a single printing plate is arranged in the axial direction of the forme cylinder, for example. A total of five print units 07 for use in applying four printing colors and black to the web are provided, not all of which five print units 07 are specifically shown in the drawing figure.

After passing through the print units 07, the paper web 04 passes through a web dryer 08 for the purpose of drying the ink which was freshly imprinted on the web 04. The paper web 04, which is emerging hot from the dryer 08, is then conducted through a cooling roller arrangement 09.

The dryer 08 and the cooling roller arrangement 09 are necessary, particularly in those cases where it is intended to employ the printing press (inter alia) for job-printing of coated paper having little absorption capability. If the printing press is intended for use in newspaper printing only, and wherein paper that is capable of significant absorption is generally employed, the dryer 08 can also be omitted.

The last structural component of the printing press is formed by a reeling device 11, on which the finished, printed web 04 is again rolled up into a roll 12.

In this printing press, there are no transverse cutting and folding devices located in the path of the paper web 04. This means that an important limiting factor of the web running speed, at which the printing press can be operated, does not apply. High production speeds can thus be achieved on this printing press.

Every time the capacity of the reeling device 11 is reached, or a print job has been completed, the rewound roll 12 is removed from the reeling device 11 and is taken away. Several imprinted rolls 12 are generated in this way. In another variation of the present invention, it is possible to employ several printing presses for forming the imprinted rolls.

Figure 2:
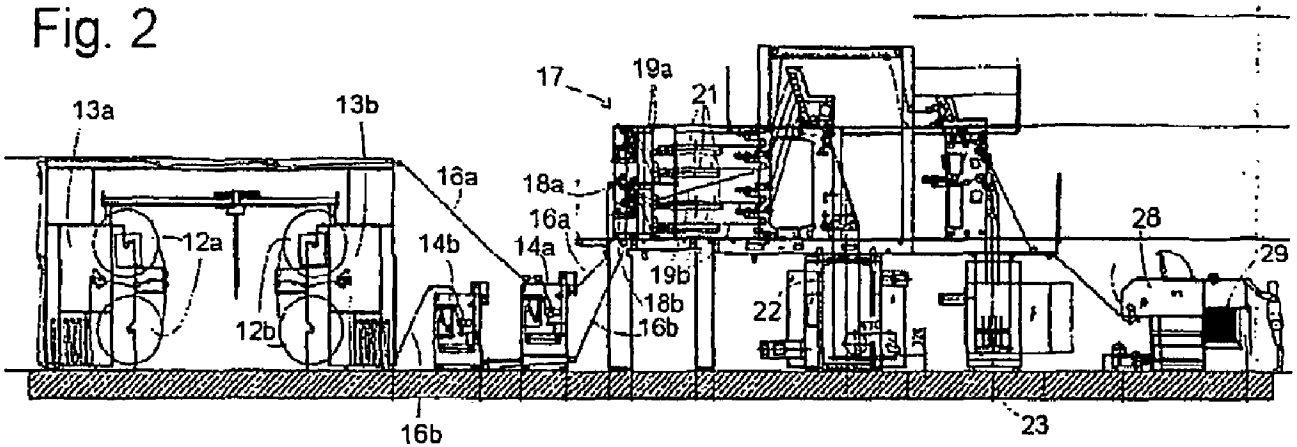
Figure 3:
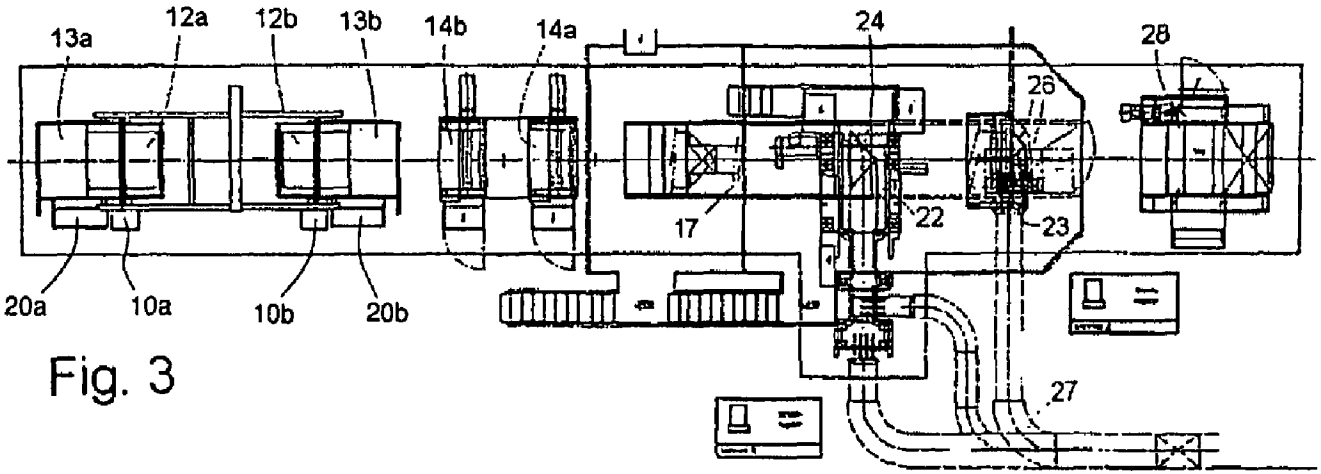

The imprinted rolls 12 are then further processed in the separating device which is represented schematically in FIGS. 2 and 3. The first structural unit in the separating device is at least one unreeling device 13, which at least one unreeling device 13 can be structurally identical to the unreeling device 01 in FIG. 1. In the preferred embodiment of FIGS. 2 and 3 there are two unreeling devices 13*a* and 13*b* provided. Depending on the number of pages of the resultant printed product to be produced, larger numbers of unreeling devices 13 can be provided in a separating device. Each such unreeling device 13*a*, 13*b* may be provided with its own separate position-controlled electric drive mechanism 10*a*, 10*b* respectively. A separate control device 20*a*, 20*b* respectively can be provided for each electric drive mechanism 10*a*, 10*b* respectively. These control devices are operable to maintain registration of the previously imprinted webs of material unwound by the unreeling devices 13*a*, 13*b*, all as seen in FIGS. 2 and 3.

The web running direction in the roll changers 01 of the web-fed printing press, and the web running direction of the roll changers 13*a*, 13*b* in the further processing device extend in parallel.

Each of these unreeling devices 13*a*, 13*b* is provided with rolls 12*a*, 12*b* of webs which had previously been imprinted in the printing press. The rolls 12*a*, 12*b* of previously imprinted webs, which are simultaneously being processed in the separating device, can be rolls 12 which were previously imprinted at different times on the printing press in FIG. 1. This means that, in a method which differs from that employed in a customary continuous print installation, in which webs simultaneously imprinted in different print units are brought together and are together conducted to a separating device, in the further processing device, and not considering re-tooling times, a conveying speed of the webs in the separating device of the separate further processing device is sufficient which is only half the magnitude of the conveying speed in the printing press in order to separate the entire production of the latter. Looked at from a different viewpoint, the division of the overall machine and process into a printing press and a processing device makes it possible to produce printing products, which can be put together from several imprinted webs, without it being necessary to make print units simultaneously available for the production of each one of these webs. It is quite obvious that a very flexible production is possible in this way with low investment costs.

Referring again to FIGS. 2 and 3, draw-in units 14*a*, 14*b*, which can be structurally identical with the draw-in unit 06 of the printing press, are arranged downstream of each of the unreeling devices 13*a*, 13*b*. The imprinted webs 16*a*, 16*b*, which are tension-regulated in the draw-in unit 14*a* or 14*b*, are conducted to a superstructure 17, at whose inlet there are situated rotating cutters 18*a*, 18*b* which separate each of the imprinted webs 16*a*, 16*b* longitudinally into several partial webs 19*a*, 19*b*. In the example depicted in FIG. 2, it can be seen that the web 16*a* is cut longitudinally into two partial webs 19*a*, and that the web 16*b* is cut longitudinally into three partial webs 19*b*, whose partial web widths, assuming a width of the original webs 16*a*, 16*b* of four pages, could be for example, 2 pages, 2 pages and 2 pages, 1 page, 1 page. For example, one page corresponds to respectively one newspaper page. A turning bar arrangement 21 is used for mixing the partial webs 19*a*, 19*b*.

The partial webs 19*a*, 19*b*, which are mixed in the turning bar arrangement 21, are distributed onto two folders 22, 23. Folder 22, as can best be seen in the top plan view in FIG. 3, is equipped with a former 24, which is centered on the uncut original webs 16*a*, 16*b* and which extends over the entire web width. The second folder 23 has two formers 26, each of half the width of the former 24, which are respectively each centered on one of the partial webs 19*a*, 19*b* formed by the centered longitudinal cutting of the web 16*a* or 16*b*. Finally, the partial webs are combined in the folders 22, 23, by transverse cutting and by transverse folding, into the finished printed products and are delivered to a conveyor belt 27.

A sheet delivery device 28 is also shown in FIGS. 2 and 3 of the drawings, and is arranged parallel with the folders 22, 23. A web or a partial web can be supplied to the sheet delivery device 28 for cutting it transversely there and to deliver it, in the form of individual sheets, to a sheet stack 29.

In general, the printing press shown in FIG. 1, and the separating device shown in FIGS. 2 and 3 would be placed spatially closely together to keep the transport paths of the imprinted rolls 12 from the reeling device 11 of the printing press to the unreeling devices 13*a*, 13*b* of the separating device short. The web-fed printing press and the further processing device are typically arranged in a common building. However, this is not necessary. It is conceivable to deliver imprinted rolls from print shops at different locations to a central location for separation for performing the separation there. It is possible, in this way, to have different parts of a standardized printing order printed at different locations, and to combine them into the finished printed product only at the central location of the separating device. This makes it possible for several print shops to pool their capacities for completing orders which would exceed the capacity of a single one of them, or to make use of remaining capacities by taking on partial orders and in this way to achieve a high degree of use of their machines.

It is also within the scope of the present invention to flexibly produce printed products which consist, such as many daily newspapers do, of a super-regional uniform portion and of regionally specific portions. The super-regional portion is typically printed at a central location, in large editions, while the local portions are each respectively printed at different locations in smaller editions. In accordance with the present invention, it is possible to distribute the rolls with the super-regional portion to the different locations and to combine them there with the regional portions and to make them into individual newspapers of the regional locations.

The configuration of the separating device represented in FIGS. 2 and 3 permits the production of printed products with up to 32 pages, if two rolls 16*a*, 16*b*, each imprinted by the use of a 16-page printing press, are combined and are individualized. It would, of course, be possible to easily increase the number of unreeling devices, and therefore to also increase the number of imprinted rolls which can be simultaneously processed in order to make products with 48 or 64 pages, from three or four webs, for example.

The processes or steps of the imprinting of the web, and the separation of the imprinted web into individual printed products become independent of each other by use of the present invention. They can take place at different times, in different locations and/or at different speeds.

The line for further processing can be complemented, for example, by varnishing units, by perforating units, by retaining units, by card-securing adhesive systems, by glue application, as well as by variable rotogravure folding apparatus.

While a preferred embodiment of a method for the production of a printed product, a processing device, and a system for the production of printed products, in accordance with the present invention, have been set forth fully and completely hereinabove, it will be apparent to one of skill in the art that various changes in, for example, the specific structure of the unrolling devices and of the reeling devices, as well as of the printing units, could be made without departing from the true spirit and scope of the present invention which is accordingly to be limited only by the appended claims.

What is claimed is:

1. A processing device of a web-fed printing press comprising:

at least first and second unreeling devices adapted to unwind previously imprinted, and rewound at least first and second webs of material;

a separate position-controlled electric drive mechanism for each of said at least first and second unreeling device a control device adapted to control each said separate position-controlled electric drive mechanism for each of said at least first and second unreeling devices to maintain registration of said at least first and second, previously imprinted and rewound webs of material as said at least first and second previously imprinted and rewound webs of material are unwound by said at least first and second unreeling devices;

a draw-in unit arranged downstream, in a direction of web travel, of each of said at least first and second unreeling devices;

a longitudinal web cutting device arranged directly after each said draw-in unit in said direction of web travel and usable to selectively cut each of said at least first and second webs of material into partial webs;

a turning bar arrangement located after each said longitudinal web cutting device and adapted to mix said partial webs; and at least one former, at least one transverse cutting device and at least one transverse folder after each said turning bar arrangement and each adapted to produce a printed product put together from said registered, previously imprinted and rewound webs of material which have been unwound from said at least first and second unreeling devices by said separate position-controlled electric drive mechanisms for each of said at least first and second unreeling devices and selectively cut into said partial webs.

2. The processing device of claim 1 wherein said at least one former is centered on an uncut one of said unwound, previously imprinted, rewound webs of material web, and a second former, said second former being centered on one of said partial unwound, previously imprinted, rewound webs of material cut by said longitudinal web cutting device.

3. The processing device of claim 1 wherein said web-fed printing press is a 16-page printing press.

4. The processing device of claim 1 wherein said printed product produced from said unwound, previously imprinted, rewound webs has 32 pages.

5. The processing device of claim 1 wherein said web-fed printing press is a jobbing printing press.

* * * * *